United States Patent [19]

Alexander, Jr.

[11] 4,368,909

[45] Jan. 18, 1983

[54] OIL WELL BAILER APPARATUS

[75] Inventor: Granison T. Alexander, Jr., New Orleans, La.

[73] Assignee: Chromalloy American Corporation, St. Louis, Mo.

[21] Appl. No.: 249,103

[22] Filed: Mar. 30, 1981

[51] Int. Cl.[3] ..... F04B 17/00

[52] U.S. Cl. ..... 294/69 R; 417/12; 417/410; 166/168; 166/75 R

[58] Field of Search ..... 166/168, 75 R; 294/68, 294/69 R, 69 A; 417/12, 410, 415

[56] References Cited

U.S. PATENT DOCUMENTS

| | | | |
|---|---|---|---|
| 1,574,809 | 3/1926 | Gilbreath | 294/69 R |
| 4,037,662 | 7/1977 | Bowling | 166/168 X |
| 4,086,035 | 4/1978 | Klaeger | 166/168 X |

*Primary Examiner*—Alan Cohan

[57] ABSTRACT

An oil well bailer apparatus for use in bailing oil from an oil well. It includes a housing adapted for mounting over the top of the wellhead and a bail bucket which is arranged for lowering and raising between the well and the housing for raising oil to the housing and depositing it at the wellhead surface.

5 Claims, 7 Drawing Figures

OIL WELL BAILER APPARATUS

FIELD OF THE INVENTION

This invention relates to an oil well bailer apparatus sometimes referred to as a bailer pump for use in bailing oil from an oil well, for example.

BACKGROUND OF THE PRIOR ART

In many instances it is not economical to pump oil from an oilwell using conventional means such as prior art sucker rod pumps or centrifugal pumps. There has long been a need for an automatic pumping unit which can utilize a bail bucket to lift oil from a rather shallow location to the surface. There has been certain apparatus developed for this purpose, but none of them fully as satisfactory as the present invention. U.S. Pat. Nos. 4,037,662 and 4,086,035 are generally illustrative of the state of the art with respect to bailer type pumps for oil wells over which the present invention is considered an improvement.

It is therefore an object of this invention to provide an improved oil well bailer pump or apparatus which overcomes the disadvantages of prior art devices and which provides a substantial step forward in the art with respect to this type of pumping operation.

Briefly stated, the invention includes an elongated housing adapted for mounting on the top of the wellhead of the well to be bailed. A pulley is rigidly supported on an upper portion of the housing for supporting a cable thereon. Seal means are provided for sealing the upper end of the housing against escape of fluid such as free gases or casing gas, if needed. The bail bucket is arranged for up and down movement between the housing and well for raising oil from the bottom of the well to the housing. A cable is connected to the upper portion of the bail bucket and passes upwardly through the seal means and over the pulley for raising and lowering the bail bucket in the well to thereby lift oil to the housing. Means are provided for selectively paying out and taking up the cable to effect alternate raising and lowering of the bail bucket in the well. The invention also includes valve means connected to a lower portion of the housing for normally sealingly closing the housing to prevent escape of fluids such as free gas therefrom and to permit passage of the bail bucket therethrough and which valve means is movable to an open position to divert oil from the housing.

The invention also includes operator means associated with the bail bucket and the housing for moving the valve means to the open position and dumping oil from the bail bucket incident to the arrival of the bucket at the end of the upper travel thereof in said housing.

Certain embodiments of the invention may include means to prevent excessive flexing of the cable at its point of attachment to the bucket. Thus, there is provided a connecting bushing connected to an upper portion of the bucket and having a portion of the cable movably extending downwardly therethrough. Stop means are fixedly attached to the cable at a point below the connection bushing for engaging the connection bushing and thereby limiting movement of the cable upward relative thereto. Spring means in the form of a tension spring is connected between the stop means and a portion of the bucket for exerting a downward biasing force on the cable relative to the bucket to take up slack in the cable when the bucket contacts oil in the well on the downward travel of the bucket.

The operator means may also include a valve member mounted near the bottom of the bucket and arranged for closing the bottom of the bucket in the down position and opening the bottom of said bucket in the raised position, together with an operator rod connected to the valve member and extending upwardly in the bucket. There is also included a pivotal rocker arm connected to an upper part of the bucket and having one end attached to the operator rod for raising and lowering the same during pivoting thereof. A striker pin is connected to the other end of the rocker arm and extends upwardly from the upper end of the bucket, with the upper end of the said striker pin being arranged to be contacted and depressed when the bucket nears the end of the upper travel thereof in the housing, whereby the pin is depressed and the operator rod is raised, thereby moving the valve member to the open position to dump oil from the bucket.

Certain embodiments of the invention may also include a vertically movable striker plate supported in the upper portion of the housing for contact by the striker pin. At least one polished rod is connected to the plate for vertical movement therewith and which rod extends through the upper end of the housing in sealed relationship therewith. This embodiment also includes means for connecting the polished rod to the valve means externally of the housing to move the valve means to the open position coincident with the arrival of the bucket at the upper end of the housing.

DESCRIPTION OF THE PREFERRED EMBODIMENT

Figure 1:
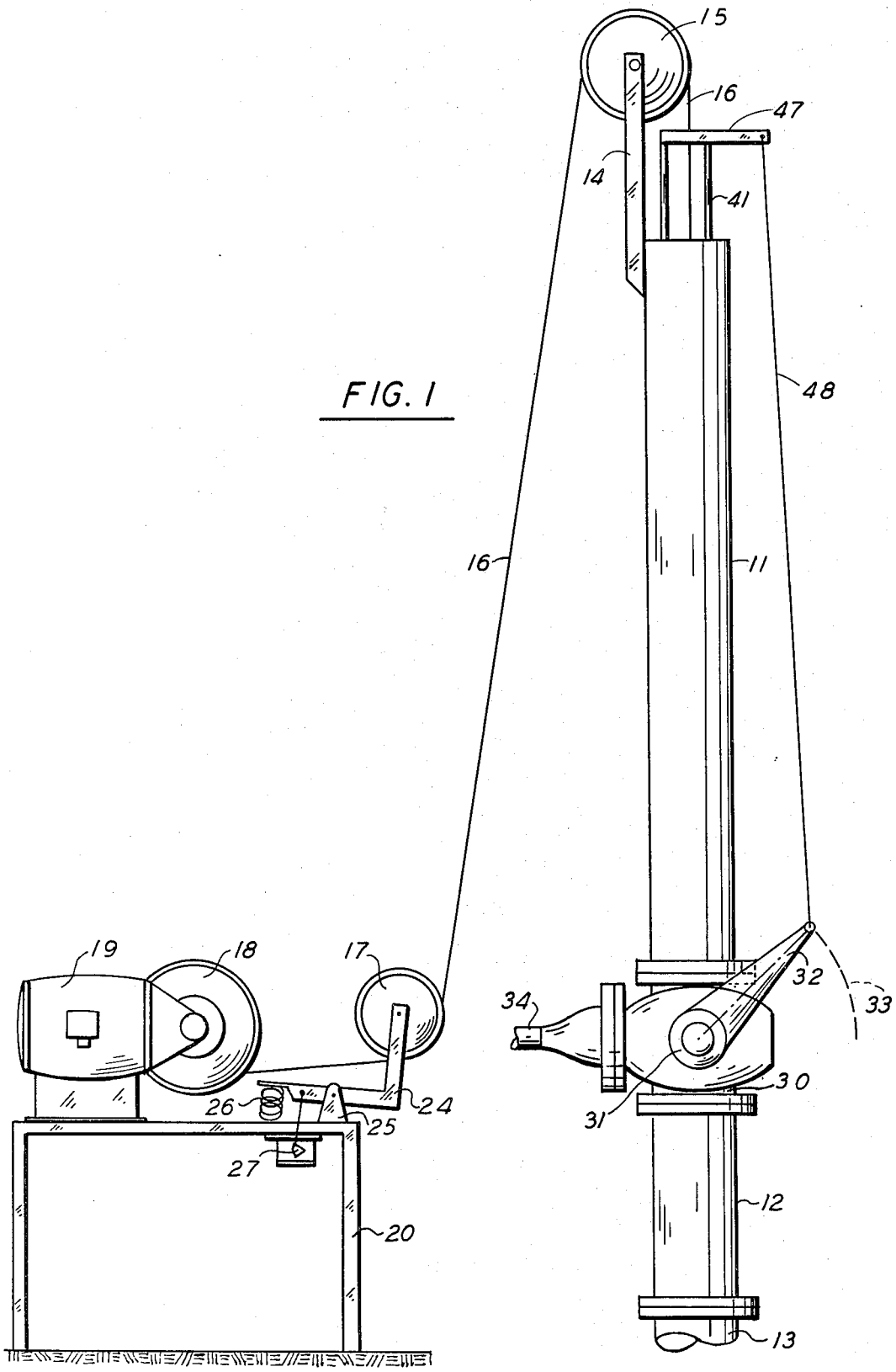
FIG. 1 is a side elevation view of one preferred embodiment of the apparatus of this invention.

Referring now to the drawings, and FIG. 1 in particular, the apparatus of this invention includes an elongated housing 11, generally tubular in shape, shown vertically mounted over a wellhead 12, which in turn is mounted over the well casing 13.

Housing 11 has rigidly attached therewith an upstanding bracket 14 which supports pulley 15 thereon over which is trailed cable 16 which is attached to a bailer bucket (not shown in this view) inside of housing 11 at one end, and the other end of which is trailed under pulley 17 and connected to cable drum 18 which is arranged for alternate rotation by reversible motor 19, mounted on support 20.

Pulley 17 is supported for rotation on generally L-shaped lever bracket 24 which is pivotally mounted on fulcrum 25 attached to support 20. The other end of bracket 24 has supported therebeneath coil spring 26 which is arranged to exert an upward biasing force against the arm of bracket 24, thereby tending to urge pulley 17 downwardly. The arm of bracket 24 is also connected to a plural position reversing switch 27 having built-in time delay means as will be described hereinafter.

Housing 11 has attached to the lower end thereof and forming a part thereof a flanged or screwed pipe nipple 30 which has mounted therein a full opening valve 31 arranged to be operated by valve crank 32. Valve 30 is arranged to be moved to the closed position shown in FIG. 1 by raising on crank 32 to the position shown. It is arranged to return to the full open position by a torsion spring (not shown) which causes crank 32 to be rotated downwardly along the dotted line 33. Valve 31 is arranged such that in the lowered position of valve crank 32, fluid flow is permitted through discharge pipe 34 while fluid flow from wellhead 12 is sealed shut to prevent the escape of fluids such as gas. When valve crank 32 is rotated to the lower position descibed above, valve 31 is full opening so that the bucket of this invention (not shown in this figure) may freely pass upwardly and downwardly therethrough. If desired, valve 31 could optionally be in the form of a three-position valve to seal casing 13 during the dumping of oil.

Figure 2:
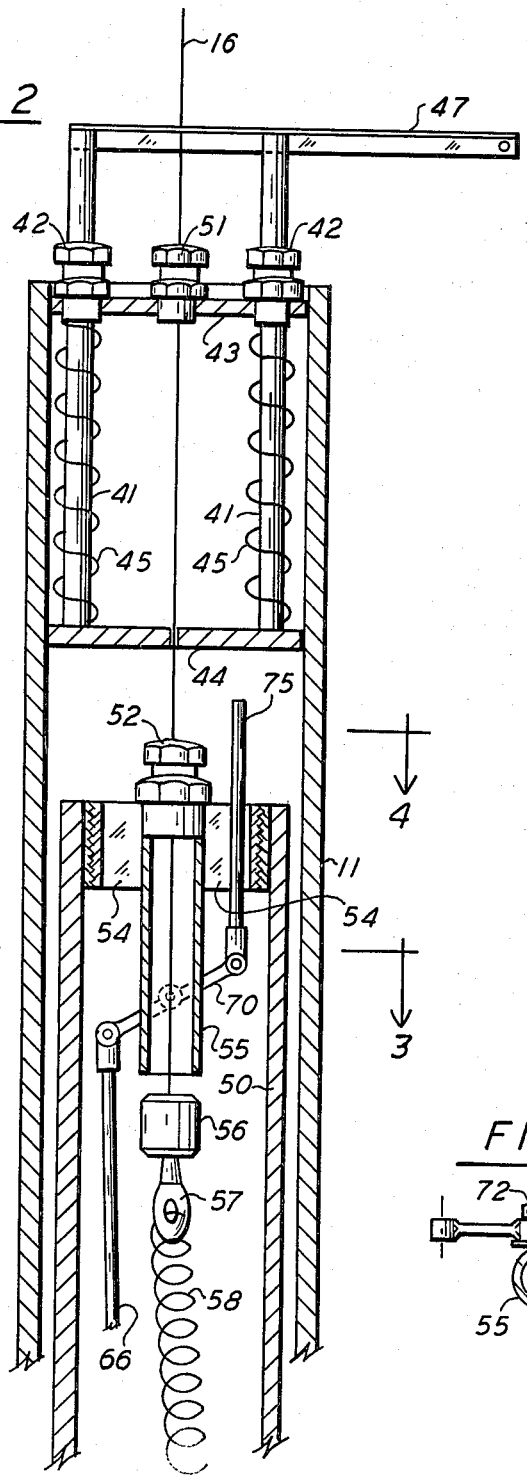
FIG. 2 is a generally central sectional view in enlarged form, showing a portion of the bail bucket arranged for moving up and down in the housing portion of the apparatus shown in FIG. 1, and showing the same near the end of the upper travel thereof.

Referring now to both FIGS. 1 and 2, housing 11 has shown extending upwardly therefrom a pair of polished rods 41, each of which passes through a packing gland 42 mounted in top plate 43 closing the upper end of housing 11.

The lower ends of polished rods 41 are rigidly attached to an annular yoke plate 44 which is arranged for vertical travel up and down inside housing 11. Yoke plate 44 and hence polished rods 41 are biased downwardly by means of a pair of springs each of which is designated by the numeral 45 and one of which is mounted about each of the rods 41 as shown. Hence yoke plate 44 is arranged to be moved upwardly by a positive force applied to the lower side thereof which in turn projects polished rods 41 upwardly through packing glands 42.

The upper ends of polished rods 41 have attached therewith a transversely or horizontally extending actuator arm 47 which travels up and down with rods 41 and yoke plate 44. Operator arm 47 has attached therewith and depending therefrom an actuator cable 48, the lower end of which is attached to valve crank 32, as shown in FIG. 1. Hence, upon upward movement of actuator arm 47, cable 48 pulls valve crank 32 upwardly to move valve 31 to the position shown in FIG. 1, where oil may be discharged through discharge pipe 34. The oil which is dumped from the bail bucket (not shown in FIG. 1) flows by gravity out discharge pipe 34 when valve 31 is in the position shown in FIG. 1. Upon downward movement of actuator arm 47, the upward lifting force on valve crank 32 is relieved and valve 31 is returned to the full opening position by means of the torsion spring heretofore described, to permit entry of the bail bucket into the well casing.

Figure 5:
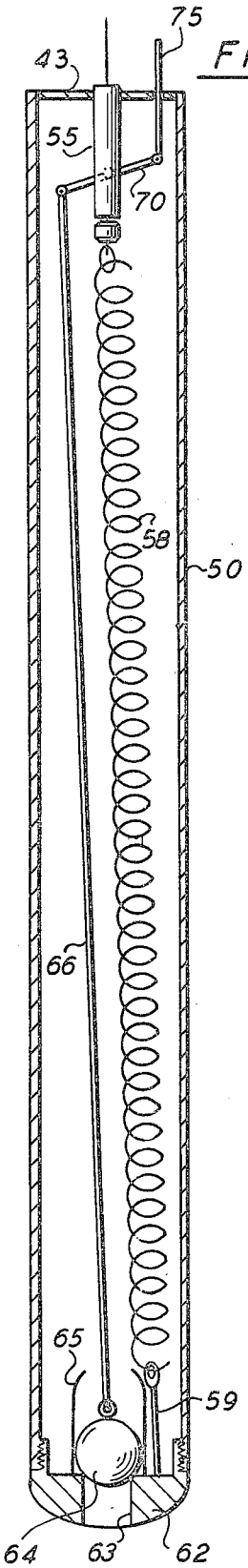
FIG. 5 is an enlarged sectional view of the bail bucket shown in FIG. 1.

The invention also includes a bail bucket designated generally by the numeral 50 as shown in FIGS. 2 and 5, which bucket is generally tubular in shape and is of a diameter slightly smaller than the inside diameter of housing 11 such that it may pass freely upwardly and downwardly therethrough. In addition, bailer bucket 50 is dimensioned for passage through valve 31 when valve 31 is in the full opening position heretofore described.

Figure 4:
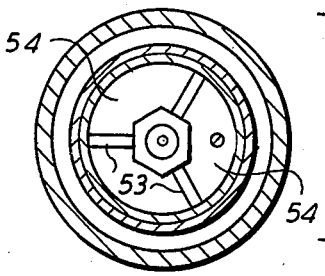
FIG. 4 is a cross-sectional view taken generally along line 4—4 of FIG. 2.

Bail bucket 50 is supported for vertical up and down movement in housing 11 in the oil well by means of cable 16, which extends downwardly through packing gland 51 in top plate 43 and through a central opening in yoke plate 44 and downwardly through connector bushing 52. Connector bushing 52 is connected to the upper end of bail bucket 50 by means of a spider having a plurality of vertically-extending webs 53 as best seen in FIG. 4, which provide for three openings 54 which are arranged to receive oil thereinto when bucket 50 is submerged in oil.

Connector bushing 52 has attached thereto and extending downwardly therefrom pipe nipple 55 which is arranged for contact by stop member 56 which is rigidly fixed on the lower end of cable 16. Immediately beneath stop member 56 and also attached to cable 16 is an eye pin 57 which has attached therewith and extending downwardly therefrom a damper spring 58, the lower end of which is attached to the inside portion of the lower end of bucket 50 by connector 59. Hence, spring 58 normally exerts a downwardly biasing force on cable 16 to keep the same relatively taut and avoids excessive slack therein when bucket 50 is lowered into the well and strikes the oil level. Conversely, on the upstroke, cable 16 travels upwardly relative to bucket 50 until stop member 56 contacts pipe nipple 55, at which point bucket 50 is carried upwardly therewith.

Figure 3:
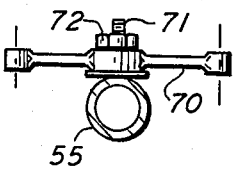
FIG. 3 is a central sectional view taken generally along line 3—3 of FIG. 2.

The lower end of bail bucket 50 is closed by lower end wall 62 having a central axial opening 63 therethrough which is arranged by closure by vertically movable ball valve member 64 arranged for vertical movement within cage 65 surrounding the same. Valve member 64 is attached to the lower end of pusher rod 66 which extends substantially vertically inside bucket 50 and is pivotally connected at its upper ends with rocker arm 70 as shown in FIGS. 2, 3 and 5, and 3 in particular. Rocker arm 70 is attached as by pin 71 and nut 72 to the side of pipe nipple 55.

The opposite end of rocker arm 70 has pivotally attached therewith a vertically upwardly extending striker pin 75 which extends upwardly through an opening 54 and above the top end of connector bushing 52 as best seen in FIG. 2. Striker pin 75 is arranged to contact yoke plate 44 during the final stages of the upward movement of bucket 50 and carry yoke plate 44 therewith, which in turn causes valve 31 to be rotated to the position shown in FIG. 1 as described above. In addition, contact of striker pin 75 with yoke plate 44 causes rotation of rocker arm 70 and consequently lifting of pusher rod 66 to unseat ball valve member 64, to thereby dump oil contained in bucket 50 out opening 63 where it thereafter flows out discharge pipe 34.

In operation, assume that bail bucket 50 is filled with oil and moving upwardly near the end of the upward stroke as shown in FIG. 2. Bucket 50 is being lifted by the taking up of cable 16 on drum 18 by operation of motor 19. Continued takeup causes bucket 50 to rise such that striker pin 75 engages yoke plate 44 and carries the same upwardly therewith, and actuator arm 47 in turn rotates valve crank 32 to the position shown in FIG. 1, whereby valve 31 provides an open conduit to discharge pipe 34. Coincidentally therewith, contact with yoke plate 44 causes striker pin 75 to be moved downwardly, thereby rotating rocker arm 70 lifting pusher rod 66 which unseats valve member 64 thereby permitting the dumping of oil out opening 63 for flow out of housing 11 through discharge pipe 34 to a collection point, such as a tank or the like.

During the upward movement of yoke plate 44 as described above, the tension of cable 16 increases to the point that lever bracket 24 is rotated in a counterclockwise direction as shown in FIG. 1 thereby depressing spring 26 and actuating switch 27 to turn off drive motor 19. Switch 27 is provided with a conventional time delay means such that after motor 19 has been stopped a few seconds, switch 27 causes reversal of motor 19 and hence payout of cable 16, thereby permitting lowering of bail bucket 50 in housing 11 and downwardly through the well bore to the bottom of the well.

When bail bucket 50 contacts the oil in the bottom of the oil well, fluid pressure raises ball valve member 64 and bail bucket 50 descends further into the oil in the bottom of the well, thereby permitting the filling of oil inside of bail bucket 50 until bail bucket 50 has reached the maximum amount of downward descent thereof. When bail bucket 50 strikes the oil as aforesaid on the downward stroke, slack is created on cable 16 such that lever bracket 24 rotates in a clockwise direction under the bias of spring 26 to move switch 27 to the alternate positions, which stops motor 19 and payout of cable 16 after a short time interval, which allows bucket 50 to fill with oil, and thereafter reverses motor 19 to raise bucket 50.

In summary then, the operational sequence stated another way is that as bucket 50 contacts the oil level in the bottom of the well on downward travel, slack is created in cable 16 which turns off drive motor 19 and start a time delay. After an appropriate delay, by operation of switch 27, motor 19 is started in the reverse direction to raise the bucket 50 in the well. At the top end of the stroke, as bucket 50 approaches the end of its upper travel, tension on cable 16 actuates switch 27 to turn motor 19 off and start the time delay, after which motor 19 is reversed and starts up to pay out cable 16.

Figure 6:
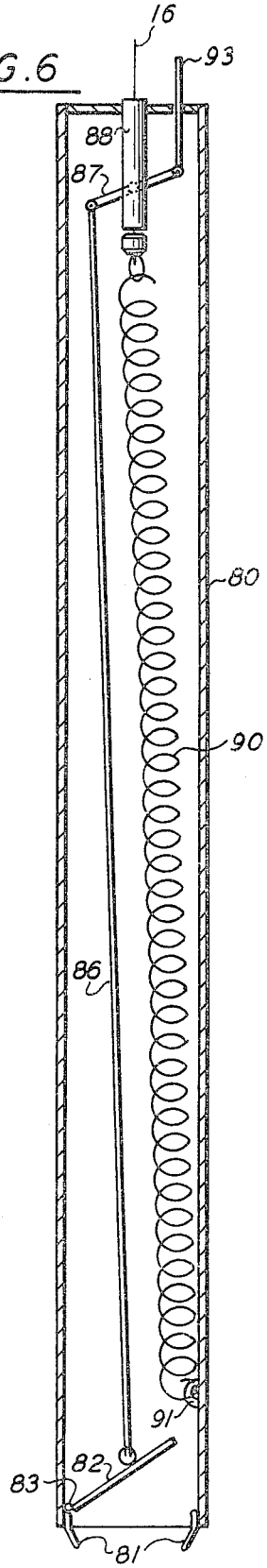
FIG. 6 is a sectional view similar to FIG. 5, but showing a different type bucket. However, the bucket could also be either hexagonal, or octagonal or other polygonal shape in cross-section.
Figure 7:
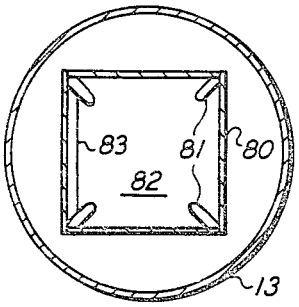
FIG. 7 is generally a bottom end view of the bucket shown in FIG. 6.

Referring now to FIGS. 6 and 7, an alternate embodiment of the bail bucket of this invention will be described. In this embodiment, the bucket is generally designated by the numeral 80 which is generally of the same length as bucket 50 of the prior embodiment, but which is generally square in cross section as shown in FIG. 7. These alternate configurations permit the use of a valve with a larger opening relative to the cross-section of the bucket, which will sink and fill faster in heavy viscous fluid. The lower end of bucket 50 is provided with a plurality of guide fingers 81 which project downwardly therefrom and taper generally inwardly as shown. The bottom end of bucket 80 is closed by valve means in the form of flapper valve member 82 supported on hinge 83 connected to the internal portion of bucket 80 as shown in FIG. 6. Valve member 82 is pivotally connected to rod 86 which is generally similar to rod 66 of the prior embodiment and in turn is connected to pivot arm 87 which corresponds to pivot arm 70 of the prior embodiment. Arm 87 pivotally connected on nipple 88 which in turn is arranged for passage of cable 16 therethrough.

Cable 16 has supported on the lower end thereof in the same manner as with the previous invention damper spring 90, the lower end of which is attached to the lower portion of bucket 80 as by lug 91. Arm 87 has connected therewith striker pin 93 which is the same as and operates in the same manner as pin 75 of the prior embodiment.

The operation of the bucket shown in FIGS. 6 and 7 is substantially the same as that of the bucket shown in FIG. 5. However, the bucket shown in FIGS. 6 and 7 has the advantage of greater clearance with interior walls of the casing through which it will operate, thereby reducing drag in heavy or viscous fluids.

In both embodiments of the bucket as shown in FIGS. 5 and 6, damper springs 58 and 90, respectively, maintain cable 16 taut when slack would normally occur therein at the bottom end of the travel of the bucket downwardly in the well. This eliminates excessive wear on cable 16 at its point of connection with the respective buckets, which might cause premature failure thereof.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the form of the invention herewith shown and described is to be taken as the presently preferred embodiment. Various changes may be made in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. In an oil well bailer apparatus, the combination comprising:

an elongated housing adapted for mounting on the top of the wellhead of the well to be bailed;

a pulley supported on an upper portion of said housing for supporting a cable thereon;

seal means sealing the upper end of said housing against fluid escape;

a bail bucket arranged for up and down movement in said housing and well for raising oil from the bottom of said well to said housing;

a cable connected to an upper portion of said bail bucket and passing upwardly through said seal means and over said pulley for raising and lowering said bail bucket in said well to thereby lift oil to said housing;

means for selectively paying out and taking up said cable to effect alternate raising and lowering of said bail bucket in said well;

valve means connected to a lower portion of said housing for normally sealingly closing said housing to prevent escape of fluids therefrom and to permit passage of said bail bucket therethrough and movable to an open position to divert oil from said housing;

and operator means associated with said bail bucket and said housing for moving said valve means to the open position and dumping oil from said bail bucket incident to the arrival of said bucket at the end of the upward travel thereof in said housing.

2. The invention as claimed in claim 1 wherein the connection of said cable to said bail bucket includes:

a connection bushing connected to an upper portion of said bucket and having a portion of said cable movably extending downwardly therethrough;

stop means fixedly attached to said cable at a point below said connection bushing for engaging said connection bushing and thereby limiting movement of said cable upwardly relative to said bucket beyond a predetermined point;

and spring means connected between said stop means and a portion of said bucket for exerting a downward biasing force on said cable relative to said bucket to take up slack in said cable when said bucket contacts oil at the bottom of said well on the downward travel of said bucket.

3. The invention as claimed in claim 1 wherein said operator means includes:

a valve member mounted near the bottom of said bucket and arranged for closing the bottom of said bucket in the down position and opening said bottom of said bucket in the raised position;

an operator rod connected to said valve member and extended upwardly in said bucket;

a pivotal rocker arm connected to an upper part of said bucket and having one end attached to said operator rod for raising and lowering the same during pivoting thereof;

a striker pin connected to the other end of said rocker arm and extending upwardly from the upper end of said bucket, with the upper end of said pin being arranged to be contacted and depressed when said bucket nears the end of the upper travel thereof in said housing, whereby said pin is depressed and said operator rod is raised to thereby move said valve member to the open position to dump oil from said bucket.

4. The invention as claimed in claim 3 wherein said operator means also includes:

a vertically movable striker plate supported in the upper portion of said housing for contact by said striker pin;

at least one polished rod connected to said plate for vertical movement therewith and extending through the upper end of said housing;

and means connecting said polished rod to said valve means externally of said housing to move said valve means to the open position coincident with the arrival of said bucket at the upper end of said housing.

5. The invention as claimed in claim 1 wherein:

said bail bucket is generally polygonal in cross-section.

* * * * *